United States Patent [19]

Koffski

[11] 4,228,871

[45] Oct. 21, 1980

[54] BRACKET

[75] Inventor: Leonard E. Koffski, Duncan, Canada

[73] Assignee: Talbot Industries, Ltd., Duncan, Canada

[21] Appl. No.: 916,143

[22] Filed: Jun. 16, 1978

[51] Int. Cl.[2] ..... F16M 11/00

[52] U.S. Cl. ..... 182/184; 182/185; 182/225

[58] Field of Search ..... 182/181–186, 182/224–226, 179, 204; 248/165, 188.2, 238; 108/146, 148, 153

[56] References Cited

U.S. PATENT DOCUMENTS

| | | | |
|---|---|---|---|
| 1,107,098 | 8/1914 | Opelt | 182/224 |
| 1,271,095 | 7/1918 | Staines | 182/184 |
| 1,832,537 | 11/1931 | Erwin | 182/179 |
| 1,841,676 | 1/1932 | Roberts | 182/185 |
| 2,583,437 | 1/1952 | Newlon | 182/181 |
| 2,891,819 | 6/1959 | Jackson | 182/184 |
| 3,080,015 | 3/1963 | Devender | 182/181 |
| 3,388,771 | 6/1968 | Corneliusen | 182/184 |
| 3,420,334 | 1/1969 | Talbot | 248/246 |

*Primary Examiner*—Reinaldo P. Machado
*Attorney, Agent, or Firm*—Smyth, Pavitt, Siegemund, Jones & Martella

[57] ABSTRACT

A bracket useful to form a free standing support on legs. The bracket comprises a cross piece to carry a platform. A pathway to receive a leg is positioned at each end of the cross piece. A sleeve is pivotally mounted on the pathway and extends when the bracket is in use, around a leg. A lever extends from the sleeve to permit pivoting of the sleeve to grip a leg positioned in the pathway and to permit the bracket to move up and down the leg. The free standing feature, together with ease of adjustment represents a considerable advantage.

21 Claims, 4 Drawing Figures

BRACKET

FIELD OF THE INVENTION

This invention relates to a bracket useful to form a free-standing structure and to a free-standing structure including the bracket.

DESCRIPTION OF PRIOR ART

Formation of scaffolding as an aid in construction work generally and in cleaning is, of course, well known. Generally speaking the scaffolding has either been relatively complex in structure or, at least, difficult to put up, particularly in large industrial scaffolding such as would be used in the refinishing of a building surface. However, even with small buildings, for example, houses, scaffolding structures have been relatively complex and have involved in many instances the mounting of the scaffolding on a wall of the house. Inside the house it is generally preferred to use step-ladders rather than to use scaffolding that must be located on the wall of a room. However, the use of scaffolding, which permits the use of a platform, is clearly desirable in internal work in a house since far greater areas can be dealt with without adjustments such as having to move a step ladder.

SUMMARY OF THE INVENTION

The present invention seeks to provide brackets useful to form a free-standing structure on legs and to a free-standing structure having legs and using the above brackets.

Accordingly, in a first aspect the present invention is a bracket useful to form a free standing structure on legs, the bracket comprising a cross piece to carry a platform; means defining a pathway to receive a leg at each end of the cross piece; a sleeve pivotally mounted on the pathway and extending, when the bracket is in its useful position, around a leg; and a lever extending from the sleeve to permit pivoting of the sleeve to grip a leg positioned in said pathway and to permit the bracket to be moved up and down the leg.

Preferably the above bracket includes upstanding members at each end of the cross piece to maintain a platform in position on the cross piece. The platform would, of course, extend to another bracket, spaced from the first bracket, to provide a free-standing scaffold or structure.

The means defining the pathway preferably comprises an open-faced channel having a back and sides and able to receive a leg of substantially rectangular cross sections. The sleeve is pivotally mounted on the back of the channel and extends around and across the open face to contact the leg. An advantage of the rectangular cross section is that a simple piece of two-by-four lumber can be used to form the legs and such lumber is freely available on any building site.

It is preferable that the channels extend outwardly and downwardly from the cross piece in order to provide a stable structure and to assist engagement by the sleeve. Furthermore, the cross pieces should be inclined relative to the pathways so the legs extend longitudinally and outwardly downwardly when a platform is in position. This again provides a more stable structure and assists engagement by the sleeve.

In one aspect of the above invention the pathway may include a runner to abut an edge of a leg when the bracket is in its useful position supporting a platform.

There are spaced, fixed sleeves extending from the runner around the pathway and the pivotal sleeve is pivotally mounted between the fixed sleeves. Such a device desirably has a recess adjacent each end of the cross piece to receive a bracing member. The bracing member extends from the first bracket to another, like bracket spaced from the first bracket. The bracing member is substantially perpendicular to the cross piece. This embodiment is of advantage particularly in larger structures, for example, to be used outside. The recess may be provided with a clamp to hold a bracing member in place.

The invention also includes a free standing structure having legs adjacent to each corner and carrying a platform. The legs are carried by brackets that support the legs in position, one bracket at each end of the platform.

BRIEF DESCRIPTION OF THE DRAWINGS

Aspects of the invention are illustrated, merely by way of example, in the accompanying drawings, in which.

DESCRIPTION OF THE PREFERRED EMBODIMENTS

Figure 1:
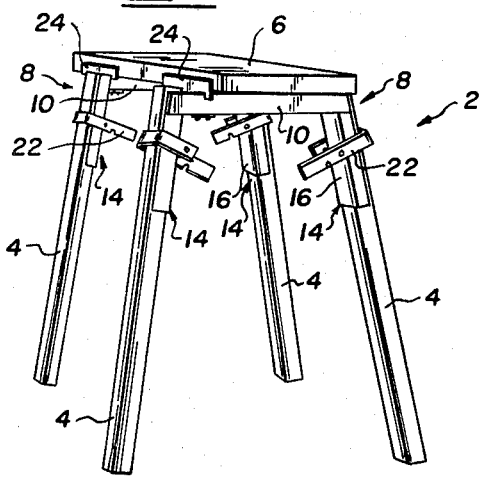
FIG. 1 is a view of a free-standing structure according to one aspect of the present invention.
Figure 2:
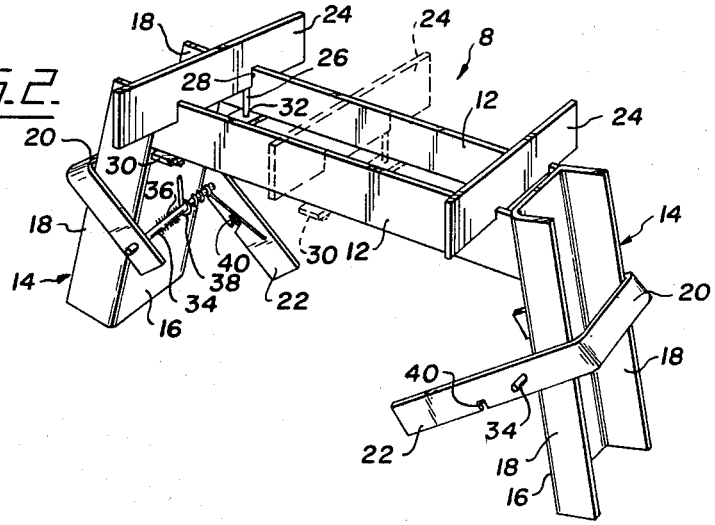
FIG. 2 is a perspective view of a bracket used in the free-standing structure of FIG. 1.

Referring to FIGS. 1 and 2, FIG. 1 shows a free-standing structure 2 having legs 4 adjacent each corner and carrying a platform 6. There are brackets 8 supporting the legs 4 in position, one bracket 8 at each end of the platform 6. As illustrated in FIGS. 1 and 2 each bracket 8 comprises a cross piece 10 to carry the platform 6. Cross piece 10 comprises spaced bars 12 in FIG. 2. There are means defining a pathway to receive a leg 4 at each end of the cross piece 10. In FIGS. 1 and 2 the means comprises an open channel member 14 having a back 16 and sides 18 and able to receive a leg 4 of substantially rectangular cross section, for example, a piece of common two-by-four lumber. There is a sleeve 20 in the form of a substantially U-shaped bracket mounted on the back 16 of the open-faced channel 14 to extend, as illustrated in FIG. 1, around a leg 4. A lever 22 extends from the sleeve 20 to permit pivoting of the sleeve 20 to grip a leg 4 in position in said pathway and, as described later, to permit the bracket 8 to be moved up and down a leg 4.

There are upstanding members 24 at each end of the cross piece 10 to maintain the platform 6 in position on the cross piece 10. As shown particularly in FIG. 2 one such upstanding member may be attached by welding to the cross piece 10 but the other is desirably provided with downwardly extending studs 26 and is provided with recesses 28 to fit over the spaced bars 12 that form the cross piece 10. There is a bar 30 provided with holes 32 to receive the studs 26. Nuts are engaged on the studs 26 to lock the bracket 30 against the bars 12 and thus locate the movable upstanding member 24 at a desired position.

The sleeve 20 is pivotally mounted on a rod 34 welded at 36 to the back 16 of the channel 14. There is a spring 38 that abuts the back 16 of the channel 14 and a projection 40 on the lever 22 attached to the sleeve 20.

The spring 38 urges the sleeve 20 to the position shown in FIG. 2.

In the embodiment of FIGS. 1 and 2 the relative positions of the channels 14 and the cross pieces 10 are such that the legs extend outwardly and downwardly from the cross pieces 10 and away from each other. This disposition of the legs 4 is shown particularly in FIG. 1.

Furthermore, the cross pieces 10 are inclined relative to the tops of the channels 14 so the legs 4 extend longitudinally and outwardly downwardly from the platform 6 when the platform 6 is in position, as shown in FIG. 1.

To use the bracket illustrated in FIG. 2 to produce the structure illustrated in FIG. 1 the legs 4 of the approximately same cross section as the channels 14 are positioned within the channels 14. The levers 22 of the sleeves 20 are urged upwardly from the position shown in FIG. 2 so that the fronts of the sleeves 20 are at the maximum possible distance from the backs 16 of the channels 14. This facilitates introduction of the legs 4 into the channels 14. A leg 4 is positioned in each channel 14, and the levers 22 are released to assume the position shown in FIG. 2. Each bracket 8 may then be raised up a leg 4 by forcing lever 22 upwardly. This moves the sleeve 20 around the pivot point defined by the point on leg 4 where the sleeve 20 contacts the leg 4. At the uppermost position of the lever 22 the lever may be released and the spring 38 will urge it back to the position shown in FIG. 2. The movement may then be repeated until the bracket has been moved up a leg 4 a sufficient height. It will, of course, be appreciated that each channel may be positioned independently for each leg 4. Thus, the device is useful on ground that is not level and, furthermore, can also be arranged so that the platform 6 is sloped. The arrangement of the sleeve 20 and of the disposition of the legs 4 relative to the platform 6 ensures an extremely stable structure, easily able to carry considerable loads.

Figure 3:
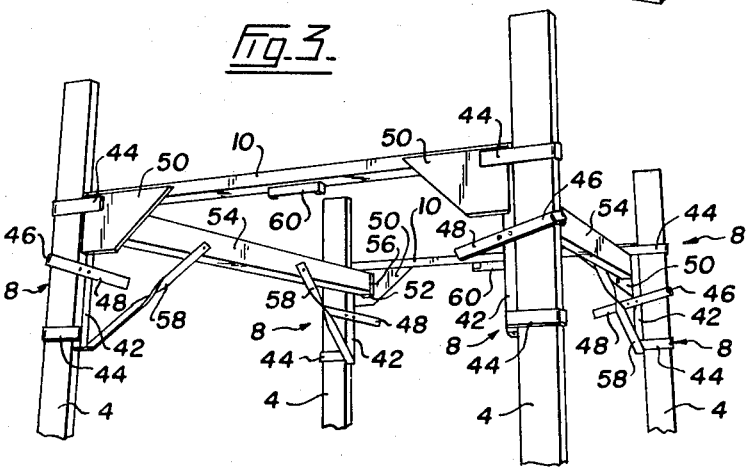
FIG. 3 illustrates a further aspect of the invention.

The embodiment of FIG. 3 is of use, for example, outside a house and generally where a large platform area is required. The platform is not shown in FIG. 3.

Figure 4:
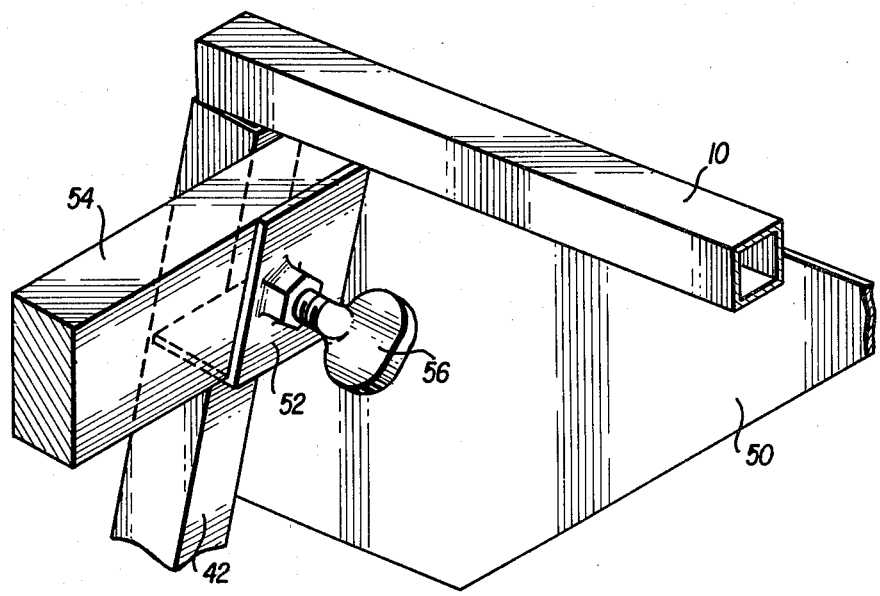
FIG. 4 is an enlarged view of a portion of FIG. 3.

The device of FIG. 3 (a portion of which is enlarged in FIG. 4) features the legs 4 and the cross pieces 10 shown in FIGS. 1 and 2. In FIG. 3 the pathway is formed by a runner 42 to abut and edge of a leg 4 when the bracket is in the useful position shown in FIG. 3. There are spaced, fixed sleeves 44 extending from the runner 42 around the pathway. A sleeve 46 having a lever 48 is pivotally mounted between the fixed sleeves 44 on the runner 42. Bracing members 50 are attached to the runner 42 and to the cross piece, for example, by welding. There is a recess 52 adjacent each end of the cross piece 10 to receive a bracing member 54 extending from one bracket 8 to another bracket 8, spaced from the first bracket. The bracing member 54 is typically substantially perpendicular to the cross pieces 8. A clamping member 56 may be threaded into a wall of a recess 52 to guide bracing member 54 in place. Braces 58 may be pivotally attached to the base of the runners 42 to be temporarily attached to the bracing members 54 to reinforce the structure. This precaution may be necessary because, as indicated above, the embodiment of FIG. 3 is typically used with larger platforms. There is also a projection 60 formed on the cross piece 10 so that when the bracket of FIG. 3 is not in use the braces 58 may be attached to the bracket 8 to maintain the bracket 8 reasonably compact for storage.

The device of FIG. 3 is used precisely as in the device of FIG. 1, that is each bracket is moved up a leg 4 by operating the lever 48 in a manner analogous to that described for FIGS. 1 and 2.

Although not as clearly shown as in FIG. 2 it should be emphasized that the legs 4 in FIG. 3 extend outwardly from the platform, both to facilitate the grip of the sleeves 46 on the legs 4 and to provide a more stable structure.

The device of FIG. 3 receives a platform (not shown in FIG. 3 for the sake of clarity). Typically planks supported on the cross pieces 10 are used.

It should be noted that the structure of FIG. 3 has no equivalent to the upstanding member 24 of FIGS. 1 and 2. The legs 4 restrict the platform in FIG. 3 and can do so in the embodiment of FIG. 1 if required.

I claim:

1. A bracket for carrying a plank on support legs comprising:

(a) a cross piece of predetermined length for carrying said plank;

(b) a runner provided at each end of the cross piece having a surface defining a support leg pathway;

(c) a plurality of spaced fixed sleeves extending from each said runner around said pathway;

(d) a sleeve pivotally mounted on said runner and extending around said pathway, said pivotal sleeve having a portion for gripping support legs mounted in said pathway; and, (e) a recess adjacent each end of said cross piece for receiving a cross bracing member extending perpendicularly between said bracket and another like bracket.

2. A bracket as in claim 1 further comprising a pair of bracing members respectively connected to said cross piece and each runner.

3. A bracket as in claim 1 further comprising a clamping member provided in a wall of the recess for guiding said cross bracing member in place in said recess.

4. A plank support system including a pair of brackets as claimed in claim 11 and further comprising a pair of cross bracing members extending perpendicularly between the cross pieces of said brackets, each mounted within respective recesses of said cross pieces.

5. A bracket for carrying a plank by means of support legs comprising:

(a) a cross piece of predetermined length for carrying a plank;

(b) respective open faced channel members connected at each end of said cross piece and extending downwardly and outwardly therefrom, the open faces of said channel members opening in opposite directions and in the direction of the length of said cross piece, one upper end of each said channel members being substantially at the same level as the top of said cross piece, said channel members and connected cross piece taking the shape of an inverted U when said cross piece carries a plank thereon; and (c) a bracket sleeve pivotally connected to each of the channel members for receiving and retaining support legs in a stationary position relative to said channel members.

6. A bracket for carrying a plank by means of support legs comprising:

(a) a continuous cross piece of predetermined length for carrying a plank on a top surface thereof;

(b) respective channel members connected at each end of the cross piece to extend downwardly and outwardly therefrom for receiving support legs, said channel members being open faced and opening outwardly in the direction of the length of said cross piece and having a U-shape, said channel members being aligned across said cross piece in a first plane and the top piece of said cross piece residing in a second plane, said first plane being inclined relative to said second plane, said channel members also residing in respective third and fourth planes located on opposite sides of said cross piece which intersect at a point above and substantially midway of said cross pieces; and, (c) respective bracket sleeves pivotally connected to each of the channel members for receiving support legs therein and retaining the support legs in a stationary position within respective channel members.

7. A bracket as in claim 6 wherein only one said bracket sleeve is pivotally connected to each of said channel members.

8. A bracket as in claim 6 wherein said cross piece has a continuous length and includes a pair of parallel spaced members extending lengthwise between said channel members.

9. A bracket for carrying a plank by means of support legs comprising:

(a) a cross piece of predetermined length for carrying a plank;

(b) respective support leg pathways connected at opposite ends of said cross piece and extending outwardly and downwardly therefrom for retaining support legs;

(c) means for retaining a support leg in a respective pathway, said means being releasable to permit selective positioning of a support leg relative to an associated pathway; and, (d) at least one adjustable upstanding member engaging with said cross piece and extending transversely thereto for holding a plank on said cross piece.

10. A bracket as in claim 9 wherein said support leg pathways are aligned on opposite ends of said cross piece in a first plane and the cross piece has a top surface aligned in a second plane, said first plane being inclined relative to said second plane.

11. A bracket as in claim 9 wherein a pair of upstanding members engage with said cross piece for holding a plank on said cross piece, at least one of said upstanding members being adjustable along the length of said cross piece.

12. A bracket as in claim 9 wherein said upstanding member has recesses for engaging with said cross piece.

13. A bracket as in claim 9 wherein said adjustable upstanding member is an adjustable plate extending transversely of said cross piece.

14. A bracket as in claim 9, further comprising means for securing said adjustable upstanding member to said cross piece at a selected adjusted position.

15. A bracket as in claim 14, wherein said securing means includes at least one stud engaging with said upstanding member which extends below and is coupled to said cross piece.

16. A bracket for carrying a plank by means of support legs comprising:

(a) a cross piece of predetermined length for carrying a plank;

(b) respective support leg pathways connected at opposite ends of said cross piece and extending downwardly and outwardly therefrom for retaining support legs;

(c) respective bracket sleeves pivotally connected to said pathways for receiving and retaining the support legs in stationary position relative to said pathways;

(d) a manually operable handle connected to each of said bracket sleeves for pivotally moving said bracket sleeves, said handles extending towards one another and inwardly of said bracket and being located on opposite widthwise sides of said cross piece.

17. A bracket for carrying a plank by means of support legs comprising:

(a) a cross piece of predetermined length for carrying a plank of a top surface thereof;

(b) respective members connected at each end of the cross piece to extend downwardly and outwardly therefrom for receiving support legs, said members being aligned across said cross piece in a first plane and the top surface of said cross piece residing in a second plane, said members also residing in respective third and fourth planes located on opposite sides of said cross piece which intersect at a point above and substantially midway of said cross piece; and (c) respective bracket sleeves pivotally connected to each of the members for receiving support legs therein and retaining the support legs in a stationary position relative to respective members.

18. A bracket for carrying one end of a plank by means of support legs comprising:

(a) a cross piece of predetermined length for carrying a plank;

(b) respective channel members connected to each end of the cross piece to extend downwardly and outwardly therefrom for receiving support legs; and (c) respective bracket sleeves pivotally connected to each of the channel members for receiving and retaining the support legs in stationary position within respective channel members, each said bracket sleeve being mounted for pivotal movement on a pivot rod attached to the back of a respective channel member, a spring being provided around said pivot rod for biasing said bracket sleeve to a position where it grips a leg placed within a respective channel member.

19. A bracket as in claim 18 wherein a lever extends from each said bracket sleeve to facilitate pivotal movement of said bracket sleeve and consequent movement of a support leg relative to a respective channel.

20. A bracket as in claim 19 wherein each said lever extends backwardly from a respective bracket sleeve toward the other bracket sleeve.

21. A bracket as in claim 19 wherein each said lever is integral with a respective bracket sleeve.

* * * * *